United States Patent [19]

Westermann

[11] 4,171,535

[45] Oct. 16, 1979

[54] LUMINAIRE FOR CONCEALED T CEILING SYSTEMS

[75] Inventor: Winfried N. Westermann, Vicksburg, Miss.

[73] Assignee: Westinghouse Electric Corp., Pittsburgh, Pa.

[21] Appl. No.: 846,467

[22] Filed: Oct. 28, 1977

[51] Int. Cl.[2] ..... F21S 1/06

[52] U.S. Cl. ..... 362/406; 362/148; 362/219; 362/427

[58] Field of Search ..... 362/147, 148, 150, 217, 362/219, 220, 225, 223, 404, 406–408, 427

[56] References Cited

U.S. PATENT DOCUMENTS

| | | | |
|---|---|---|---|
| 2,721,635 | 10/1955 | Fullerton | 362/223 |
| 2,744,716 | 5/1956 | Zingone | 362/223 X |
| 3,058,611 | 10/1962 | Chester | 362/223 |
| 3,158,330 | 11/1964 | Van Steenhoven | 362/223 |
| 3,281,588 | 10/1966 | Spinetta | 362/225 |
| 3,375,773 | 4/1968 | Wotowiec et al. | 362/150 X |
| 3,555,267 | 1/1971 | Sutter | 362/150 X |
| 3,686,496 | 8/1972 | Totten et al. | 362/217 X |
| 3,796,870 | 3/1973 | Pettyjohn, Jr. | 362/223 |
| 4,086,480 | 4/1978 | Lahm | 362/225 X |

FOREIGN PATENT DOCUMENTS

| | | | |
|---|---|---|---|
| 739315 | 7/1966 | Canada | 362/225 |
| 1139789 | 11/1955 | France | 362/225 |

OTHER PUBLICATIONS

Chic. Metallic Corp. descriptive bulletin for 434 System.

Lightolier Descriptive Bulletin PCBA 7200–48RS.

Globe Illumination Co. brochure H-2, p. 5.

*Primary Examiner*—Peter A. Nelson

*Attorney, Agent, or Firm*—B. R. Studebaker

[57] ABSTRACT

An asymmetrically mounted recessed lighting fixture which includes an integral appearance frame about the bottom edge thereof which underlies and conceals the ceiling support framework from view. The lighting fixture includes an undercut or recessed portion in one sidewall which permits mounting of the luminaire on the ceiling support framework without removal of the appearance frame which underlies and conceals the ceiling support framework.

6 Claims, 5 Drawing Figures

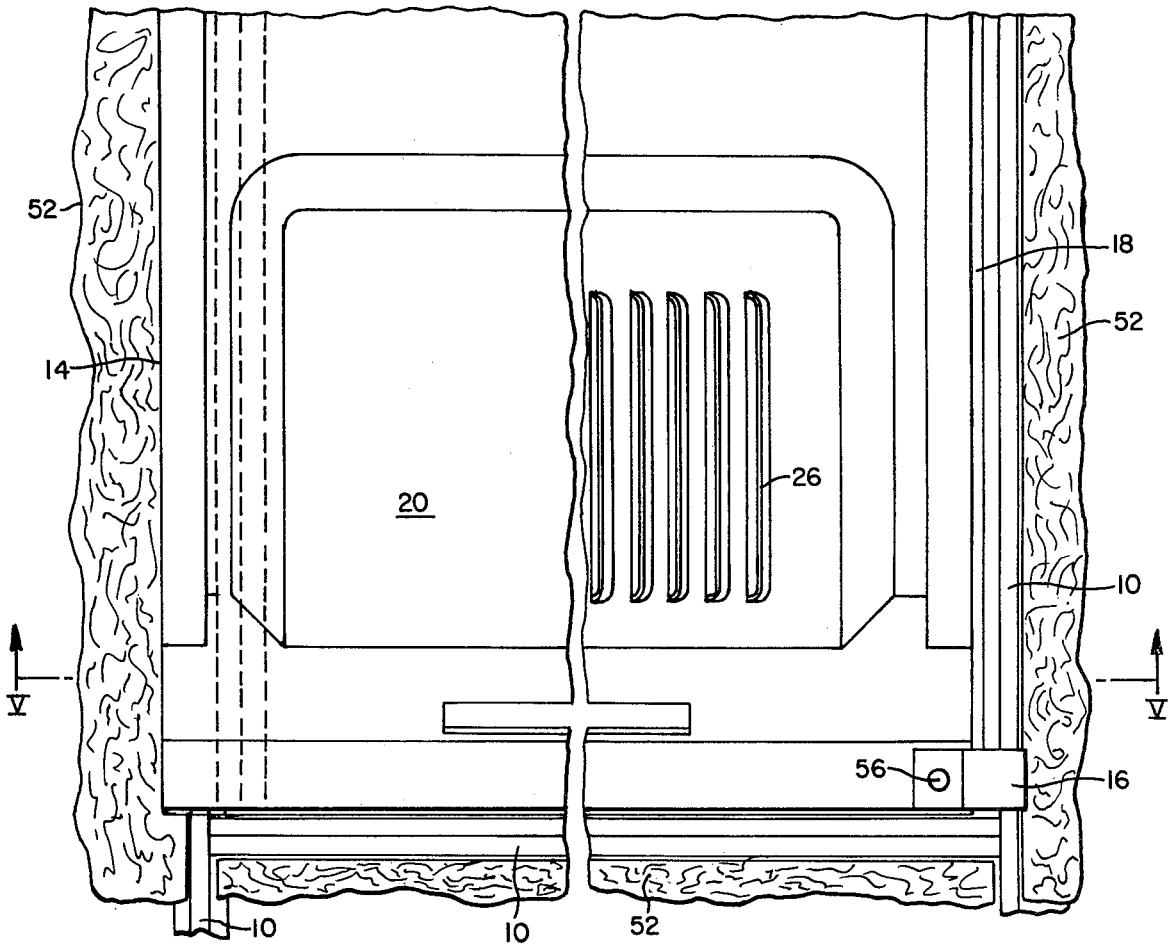
FIG. 4
FIG. 5
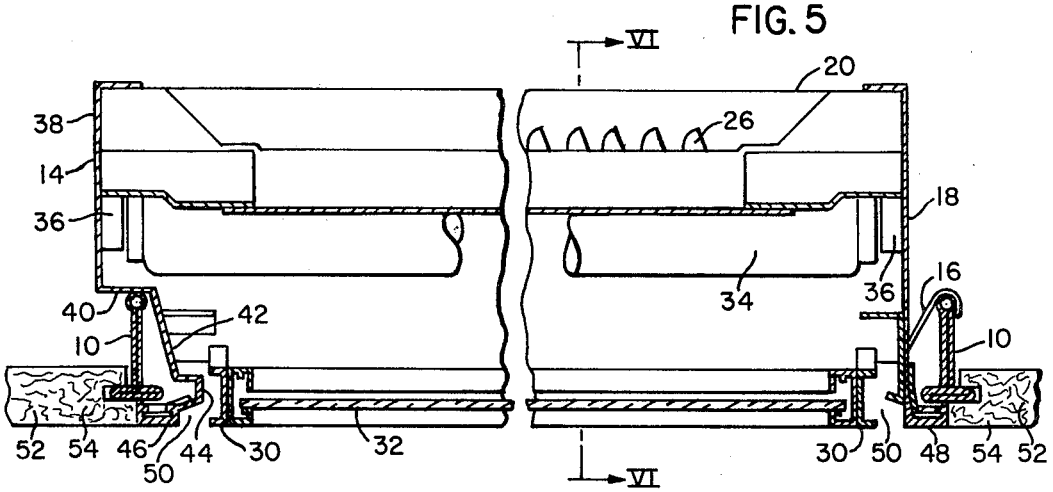

LUMINAIRE FOR CONCEALED T CEILING SYSTEMS

BACKGROUND OF THE INVENTION

In most instances, commercial lighting fixtures are employed in suspended ceiling systems wherein a framework of inverted "T" bars or the like are utilized to support the entire ceiling system as well as the lighting fixtures. In some ceiling systems, the bottom face of the "T" bar is left exposed to provide a grid-like appearance to the ceiling system. In those types of installations, simple lay-in fixtures are employed which are supported directly by the "T" bar flanges, as are the acoustical ceiling tiles. In other systems, it is preferred that the bottom face of the "T" bar ceiling support system be hidden in order to avoid the grid appearance provided by the exposed "T" bar system. In the latter case, the acoustical ceiling tiles generally have a horizontal slot in their side edges which permits the acoustical tile, when placed on the "T" bars, to hide half of the "T" bar flange face while the adjacent ceiling tile will hide the other half of that flange face. Where lighting fixtures are employed in this type of ceiling system, it is generally required that after the luminaire is mounted within the ceiling system on the supporting "T" bar framework, an exterior flange must then be secured to the luminaire in order to hide the flanges of the "T" bar adjacent the opening in which the lighting fixture is mounted.

Another method sometimes employed to hide the ceiling grid system is to employ separate steel or vinyl holding strips which are mounted directly to the flange of the "T" bar adjacent the luminaire to provide the framework for the luminaire as well as hide the grid framework. Another method of providing this shielding or concealing of the "T" bar framework is by employing a luminaire with a complex door frame which provides both the luminaire door with its appearance frame and also carries both the air return structure and a second outer frame, also secured to the door frame which extends outwardly and shields the "T" bar framework from view.

Each of the foregoing systems provides either a complex system from the standpoint of mounting or an expensive system from the standpoint of luminaire manufacture.

SUMMARY OF THE INVENTION

The foregoing deficiencies of the prior art luminaire systems for concealing the "T" bar support structure have been obviated by the present invention which provides a luminaire which carries on the housing thereof an integral appearance frame which underlies and conceals the ceiling support framework from view while also having the facility of being simply and easily installed by one man without the use of tools and the like to add additional parts to the luminaire after it is installed on the "T" bar ceiling system.

The foregoing is accomplished by providing an asymmetrically mounted, recessed lighting fixture which conceals the ceiling support framework from view, and includes a top wall, a pair of sidewalls and a pair of end walls which define a bottom opening. An appearance framework is connected to the bottom edge of each of the sidewalls and the end walls and is constructed and arranged to underlie and conceal, at least in part, the ceiling support framework. A framed refractor is mounted within the bottom opening with the frame of the refractor being spaced a uniform distance from the appearance frame. Fluorescent lamp holders are mounted to each of the end walls with one of the end walls having an inwardly and horizontally directed portion which defines a shelf to support one end of the recessed lighting fixture on the ceiling support framework with means associated with the other end wall which coact with the ceiling support framework to support the other end of the recessed lighting fixture. The inwardly and horizontally directed portion of the one end wall underlies the fluorescent lamp holders and forms a recess which permits the entire luminaire to be swung around the framework into its mounting position while permitting the appearance frame connected to the bottom edge of each of the sidewalls and the end walls to underlie and conceal the ceiling support framework surrounding the luminaire in the ceiling system.

BRIEF DESCRIPTION OF THE DRAWING

Many of the attendant advantages of the present invention will become more readily apparent and better understood as the following detailed description is considered in connection with the accompanying drawing, in which:

FIG. 4 is a partial top plan view with the central portion thereof broken away of the luminaire of this invention;

FIG. 5 is a sectional view taken along the line V—V of FIG. 4; and

DESCRIPTION OF THE PREFERRED EMBODIMENT

Figure 1:
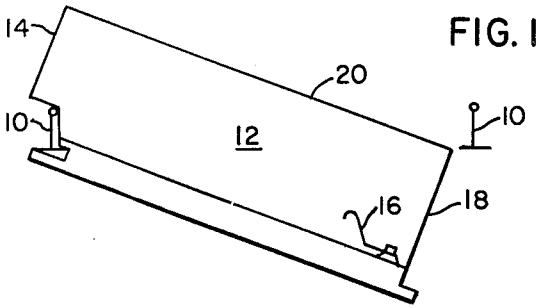
FIG. 1 is a schematic side elevation view illustrating the method by which the fixture of the present invention is installed in a ceiling system.
Figure 2:
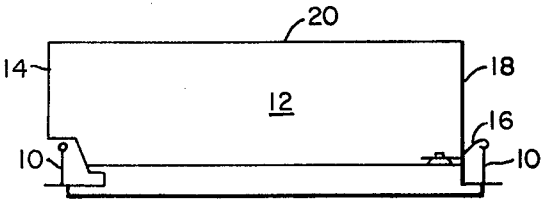
FIG. 2 is a schematic side elevation view illustrating the luminaire of this invention mounted within a ceiling support system.
Figure 6:
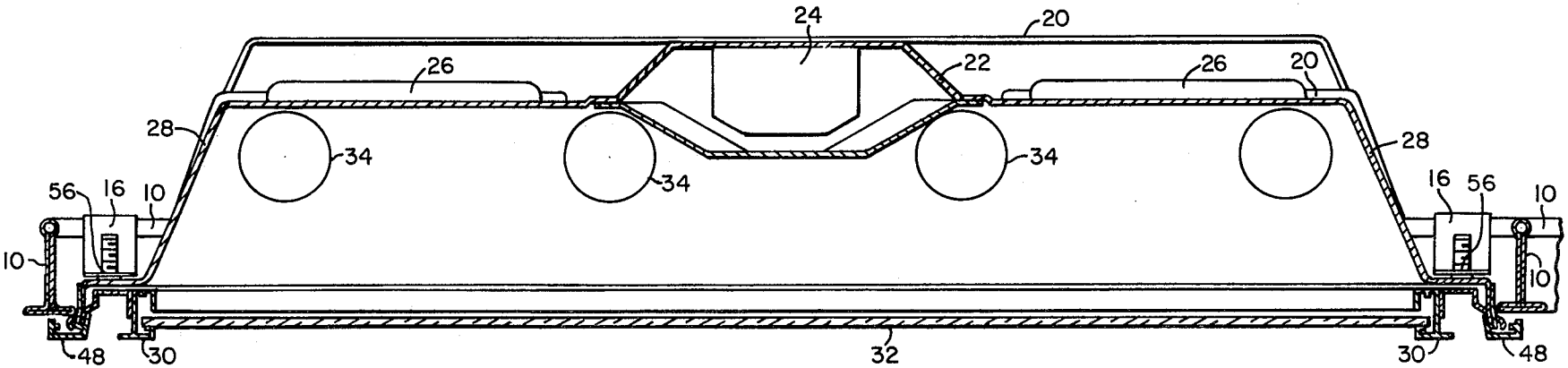
FIG. 6 is a sectional view taken along the line VI—VI of FIG. 5.

Referring now in detail to the drawing, wherein like reference characters represent like parts throughout the several views, there is illustrated schematically in FIGS. 1 and 2 the basic concept of this invention which provides an asymmetrically mounted recessed lighting fixture which is adapted to be mounted in a suspended ceiling system on the "T" bar framework while concealing the underside of that framework. Most suspended ceiling systems for commercial applications employ a metal "T" bar framework 10 to support the acoustical ceiling tiles and lighting fixtures. In some installations, the bottom faces of the "T" bar flanges are exposed to provide a lattice-work appearance in the ceiling of the room. In other installations, it is desired that these flange faces of the "T" bar system be hidden from view to provide a uniform planar surface at the ceiling. In the former situation, the mounting of lighting fixtures on the "T" bar framework presents no problem since the lighting fixture or luminaire is merely mounted on the flanges or upright portions of the "T" bar system and can be a simple "lay-in" type fixture. In the latter situation, slotted side edges in the ceiling tiles can be utilized to hide half of the flange face of the "T" bar sections surrounding the luminaire opening, but shielding of the flange face on the luminaire side presents a significant problem. As indicated previously, this can be accomplished by separate vinyl or steel shielding strips attached directly to the "T" bar, detachable trim which may be attached directly to the fixture body by screws or other mechanical means after the fixture is installed or by providing a separate complicated and cumbersome door frame to the luminaire which can underlie and shield the underside of the "T" bar flange.

As will be apparent as this description proceeds, the luminaire of this invention, generally designated 12, because of its asymmetric structure can be slipped between the "T" bar framework with, as illustrated in FIGS. 1 and 2, the left end 14 of the fixture slipped over the "T" bar and the luminaire then rotated into place while a hook support member 16 of the fixture is rotated over the "T" bar to support the other end 18 of the fixture 12.

The invention is illustrated in the form of a 4-lamp fluorescent luminaire, which includes generally a top wall 20 carrying a ballast housing 22 centrally thereof which encloses a ballast 24. The top wall may also include a plurality of vents 26 to vent the lamp enclosure defined by the top wall 20, the end walls 14 and 18 and a pair of sloped sidewalls 28. The end walls 14 and 18 along with the sidewalls 28 define a bottom opening in the luminaire housing which is closed off by a door which includes a door frame 30 and a refractor 32. The door frame 30 is hinged to one sidewall 28 and latched to the other sidewall 28 in a conventional manner to provide access to the lamp enclosure. Fluorescent lamps 34 are mounted within the lamp enclosure to the end walls 14 and 18 by lamp holders 36.

In accordance with this invention, the end wall 14 is designed to permit the lamp holders 36 associated with the end wall 14 to overlie a portion of that end wall to provide the novel mounting arrangement of this invention. The end wall 14 includes an upper vertical portion 38 extending downwardly from the top wall to an inwardly and horizontally directed portion 40 which extends inwardly to an inwardly and downwardly directed portion 42 extending from the inwardmost end of the horizontal and inwardly directed portion 40. An inwardly directed notched portion 44 and an outwardly directed flange portion 46 extend sequentially from the most inward end of the inwardly and downwardly directed portion 42. The outwardly directed flange portion 46 forms an appearance frame which coincides with and forms an extension of the remainder of the appearance frame 48 which is connected to the bottom edge of the end wall 18 and the sidewalls 28. The appearance frame 46, 48 completely surrounds and is spaced equidistantly from the door frame 30 and serves to underlie the half of the "T" bar flange adjacent the luminaire and shield that support frame 10 from view. The end wall 18 is of simple, planar, vertically oriented, sheet metal construction.

At the ends of the door frame 30 adjacent appearance frame 46 and 48, a space 50 is provided therebetween to permit air to be drawn through the opening 50, sweep the lamps 34 and exit into the plenum space above the luminaire through vents 26.

The combination of the ceiling tiles 52 with their extended flange 54 and the appearance frame members 46 and 48 completely shield or conceal the ceiling support framework defined by "T" bars 10.

Figure 3:
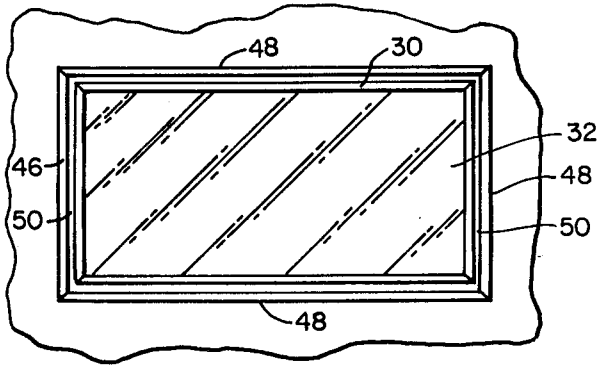
FIG. 3 is a bottom plan view of the luminaire of this invention mounted within a ceiling support system.

As will be apparent from the foregoing, the luminaire of this invention being asymmetrically formed with an indentation or recessed portion in the lower part of the end wall 14, permits the luminaire to be mounted on a "T" bar grid frame work by simply rotating the luminaire into its mounted position by accommodating the framework "T" bar adjacent the end 14 of the luminaire in the recessed portion of that end wall. Hook members 16 rotatably mounted at 56 on the sidewalls 28 adjacent the end wall 18 can then be simply rotated to overlie the "T" bar framework adjacent the end 18 to complete the mounting of the luminaire within the ceiling support system. It will be apparent that other conventional mounting clips and methods can be used to support the end 18 of the luminaire on its adjacent support framework. In the mounted position, as illustrated in FIGS. 2 and 3, the appearance frame 46, 48 is immediately in position concealing its adjacent "T" bar flange from view and it is not necessary for a separate flange to be mechanically attached to the luminaire to form this function; nor is it required that a separate shielding means be applied directly to the framework flange as has been previously done to accomplish this shielding function. Neither does the luminaire require an enlarged and cumbersome door frame which carries a 2-part framework and its own air return slot required to accomplish the function of shielding the "T" bar framework from view.

What is claimed is:

1. An asymmetrically mounted recessed lighting fixture for concealing the ceiling support framework in a suspended ceiling system, said lighting fixture comprising:

a top wall, a pair of sidewalls and a pair of end walls defining a bottom opening;

an appearance frame connected to the bottom edge of each of said sidewalls and said end walls constructed and arranged to underlie and conceal, at least in part, said ceiling support framework;

a framed refractor mounted within said bottom opening with the frame of said refractor being spaced a uniform distance from said appearance frame;

fluorescent lamp holders mounted to each of said end walls, one of said end walls having an inwardly and horizontally directed portion defining a shelf to support one end of said recessed lighting fixture on said ceiling support framework and the other of said end walls being vertically planar; and means associated with the other of said end walls adapted to coact with said ceiling support framework to support the other end of said recessed lighting fixture.

2. The recessed lighting fixture according to claim 1 wherein said inwardly and horizontally directed portion of said one of said end walls underlies said fluorescent lamp holders mounted thereon.

3. The fluorescent lighting fixture according to claim 1 wherein said one of said end walls includes an upper vertical portion extending downwardly from the top wall to said inwardly and horizontally directed portion, an inwardly and downwardly directed portion extending from the inwardmost end of said horizontal and inwardly directed portion, and an inwardly directed notched portion and an outwardly directed flange portion including said appearance frame extending sequentially from the inwardmost end of said inwardly and downwardly directed portion.

4. An asymmetrically mounted recessed lighting fixture for concealing the ceiling support framework in a suspended ceiling system, said lighting fixture comprising:

a top wall, a pair of sidewalls and a pair of end walls defining a bottom opening;

an appearance frame connected to the bottom edge of each of said sidewalls and said end walls constructed and arranged to underlie and conceal, at least in part, said ceiling support framework;

a framed refractor mounted within said bottom opening with the frame of said refractor being spaced a uniform distance from said appearance frame;

fluorescent lamp holders mounted to each of said end walls, one of said end walls having an inwardly and horizontally directed portion defining a shelf to support one end of said recessed lighting fixture on said ceiling support framework and an inwardly directed notch-like portion permitting said fixture to be mounted around said ceiling support framework, the other of said end walls being vertically planar; and means associated with the other of said end walls adapted to coact with said ceiling support framework to support the other end of said recessed lighting fixture.

5. The recessed lighting fixture according to claim 4 wherein said inwardly and horizontally directed portion of said one of said end walls underlies said fluorescent lamp holders mounted thereon.

6. The fluorescent lighting fixture according to claim 4 wherein said one of said end walls includes an upper vertical portion extending downwardly from the top wall to said inwardly and horizontally directed portion, an inwardly and downwardly directed portion extending from the inwardmost end of said horizontal and inwardly directed portion to said inwardly directed notched portion and an outwardly directed flange portion including an appearance frame extending outwardly from said inwardly directed notched portion.

* * * * *